US008051895B2

(12) United States Patent
Otsuka et al.

(10) Patent No.: US 8,051,895 B2
(45) Date of Patent: Nov. 8, 2011

(54) OPERATING METHOD FOR TWIN-ROLL CASTING MACHINE, AND SIDE WEIR SUPPORTING DEVICE

(75) Inventors: Hiroyuki Otsuka, Tokyo (JP); Katsumi Nakayama, Tokyo (JP); Hiroki Yoshizawa, Tokyo (JP)

(73) Assignee: IHI Corporation, Tokyo (JP)

( * ) Notice: Subject to any disclaimer, the term of this patent is extended or adjusted under 35 U.S.C. 154(b) by 189 days.

(21) Appl. No.: 12/524,664

(22) PCT Filed: Jan. 31, 2008

(86) PCT No.: PCT/JP2008/000118

§ 371 (c)(1),
(2), (4) Date: Sep. 8, 2009

(87) PCT Pub. No.: WO2008/093505

PCT Pub. Date: Aug. 7, 2008

(65) Prior Publication Data

US 2010/0101752 A1 Apr. 29, 2010

(30) Foreign Application Priority Data

Feb. 1, 2007 (JP) ..... 2007-022833

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

| | | | | |
|---|---|---|---|---|
| 6,296,046 | B1 * | 10/2001 | Jeong et al. | 164/452 |
| 2005/0224210 | A1 * | 10/2005 | Hohenbichler et al. | 164/480 |
| 2006/0054298 | A1 * | 3/2006 | Hohenbichler et al. | 164/480 |

FOREIGN PATENT DOCUMENTS

| | | | |
|---|---|---|---|
| JP | 6-15414 | * | 1/1994 |
| JP | 11-226702 | | 8/1999 |
| JP | 2000-190053 | | 7/2000 |
| JP | 2001-38453 | * | 2/2001 |
| JP | 2004-50252 | | 2/2004 |
| JP | 2006-136930 | | 6/2006 |

* cited by examiner

*Primary Examiner* — Kuang Lin

(74) *Attorney, Agent, or Firm* — Oblon, Spivak, McClelland, Maier & Neustadt, L.L.P.

(57) ABSTRACT

An operation to acquire a strip with less thickness even if arcuate worn steps are formed on side weirs is disclosed. During an operation of a twin-roll casting machine with arcuate worn steps developing on side weirs due to rotational sliding contact of chilled rolls, the thickness of a steel strip from a nip is reduced, and the center-to-center distance between the rolls is increased with the side weirs in contact with ends of the rolls being displaced upward. This prevents interference of outer peripheries of the rolls with boundary surfaces adjacent to the arcuate worn steps of the side weirs.

1 Claim, 5 Drawing Sheets

OPERATING METHOD FOR TWIN-ROLL CASTING MACHINE, AND SIDE WEIR SUPPORTING DEVICE

TECHNICAL FIELD

The present invention relates to an operating method for a twin-roll casting machine, and a side weir supporting device.

BACKGROUND ART

Known as one of techniques for directly producing a strip from molten metal is twin roll continuous casting where molten metal is supplied to between a pair of horizontally juxtaposed rolls to deliver a solidified metal strip.

FIGS. 1-3 show an example of a twin-roll casting machine with a pair of chilled rolls 1 horizontally juxtaposed and a pair of side weirs 2 associated with the rolls 1.

The chilled rolls 1 are constructed such that cooling water passes through insides of the rolls and a nip G between the rolls is increased/decreased depending on thickness of a steel strip 3 to be produced.

Rotational directions and velocities of the rolls 1 are set such that outer peripheries of the respective rolls 1 are moved from above toward the nip G at constant velocity.

One and the other of the side weirs 2 surface-contact one and the other ends of the respective rolls 1, respectively.

Arranged between the paired side weirs 2 is a melt supplying nozzle 4 so as to be positioned just above the nip G. Molten steel is poured from a ladle (not shown) to the nozzle 4 to supply the molten steel in a space defined by the rolls 1 and side weirs 2. Thus, a melt pool 5 is provided.

Specifically, the above-mentioned melt pool 5 is formed and the chilled rolls 1 are rotated with the cooling water passing through and cooling the rolls 1, so that molten steel is solidified on outer peripheries of the rolls 1 and steel strip 3 is delivered downward from the nip G.

In this case, forces are applied to bearing boxes (not shown) for rotary support of necks of the respective rolls in directions toward each other so as to make the steel strip 3 to have a targeted thickness value.

The side weirs 2 are pushed by pressing actuators such as hydraulic cylinders against ends of the rolls 1 to prevent leaking of the molten steel (see, for example, Patent Literatures 1 and 2).

[Patent Literature 1] JP 2000-190053A

[Patent Literature 2] JP 2004-050252A

SUMMARY OF INVENTION

Technical Problems

On the side weirs 2 pushed against the ends of the rolls 1, arcuate worn steps 6 develop due to rotational sliding contact of the rolls 1 (see FIGS. 2 and 3).

Once the arcuate worn steps 6 are formed on the side weirs 2, trial of reducing center-to-center distance L between the rolls 1 is in vain since outer peripheries of the rolls 1 abut on boundary surfaces 8 lying between unworn portions 7 and the arcuate worn steps 6 on the side weirs 2. As a result, the steel strip 3 delivered from the nip G cannot be reduced in thickness.

The invention was made in view of the above and has its object to make it possible to acquire a strip with less thickness even if arcuate worn steps are formed on side weirs.

Solution to Problems

In an operating method for a twin-roll casting machine according to the invention, the above object is accomplished such that a center-to-center distance between chilled rolls is reduced with side weirs in contact with ends of the rolls being displaced upward where a strip from a nip between the rolls is to be reduced in thickness and that the center-to-center distance between the rolls is increased with the side weirs in contact with the ends of the rolls being displaced downward where the strip from the nip between the rolls is to be increased in thickness.

Specifically, the center-to-center distance between the rolls is reduced with the side weirs being displaced upward, which prevents outer peripheries of the rolls from interfering with the side weirs.

The center-to-center distance between the rolls is increased with the side weirs being displaced downward, which keeps overlapped degree of the side weirs to the ends of the rolls.

A side weir supporting device according to the invention comprises pressing actuators for pressing side weirs against ends of chilled rolls of a twin-roll casting machine, and position adjusting mechanisms for vertically displacing said side weirs.

Specifically, the center-to-center distance between the chilled rolls is reduced with the side weirs being displaced upward, which prevents outer peripheries of the rolls from interfering with the side weirs.

The center-to-center distance between the chilled rolls is increased with the side weirs being displaced downward by the position adjusting mechanisms, which keeps overlapped degree of the side weirs to the ends of the rolls.

Advantageous Effects of Invention

An operating method for a twin-roll casting machine and a side weir supporting device of the invention can attain excellent effects and advantages as mentioned below.

(1) Reduction of the center-to-center distance between the rolls is accompanied by upward displacement of the side weirs so as to prevent the outer peripheries of the rolls from interfering with the side weirs, which makes it possible to acquire a strip with less thickness even if the side weirs have arcuate worn steps formed.

(2) The side weirs can continue to be used, provided that the portions of the side weirs with the arcuate worn steps formed have remaining thickness providing strength required for an operation of the twin-roll casting machine. As a consequence, the service life of the side weirs is prolonged, leading to reduction in maintenance cost.

REFERENCE SIGNS LIST

| | |
|---|---|
| 1 | chilled roll |
| 2 | side weir |
| 3 | steel strip |
| 6 | arcuate worn step |
| 9 | pressing cylinder (pressing actuator) |
| 10 | position adjusting mechanism |
| G | nip |
| L | center-to-center distance |

DESCRIPTION OF EMBODIMENTS

An embodiment of the invention will be described in conjunction with the drawings.

Figure 1:
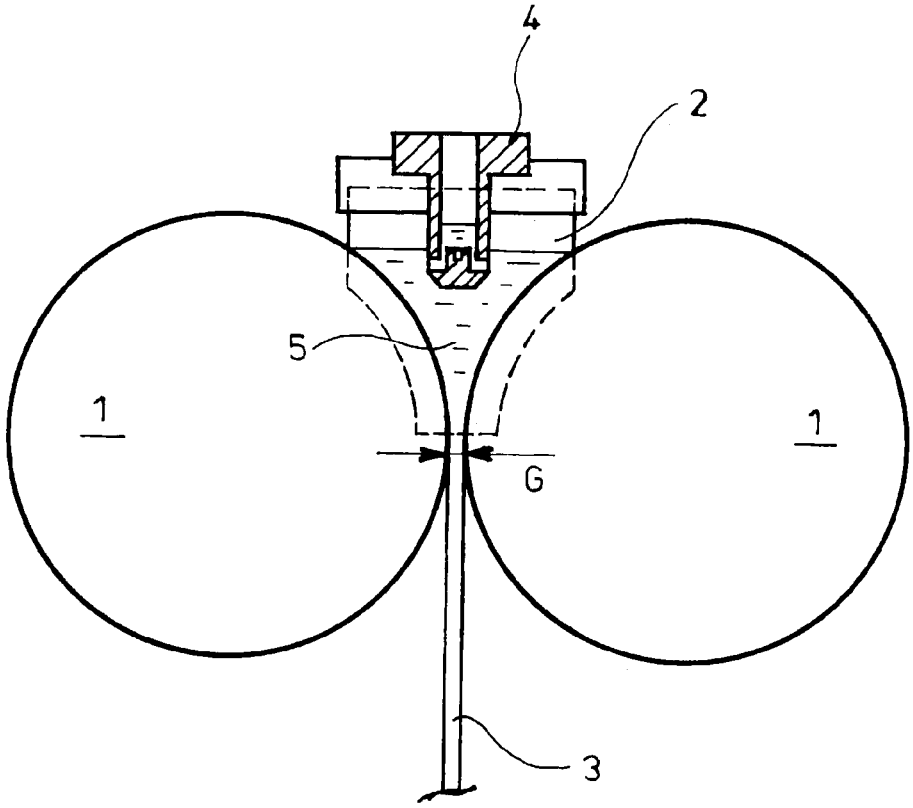
FIG. 1 is a schematic view showing a conventional twin-roll casting machine.
Figure 2:
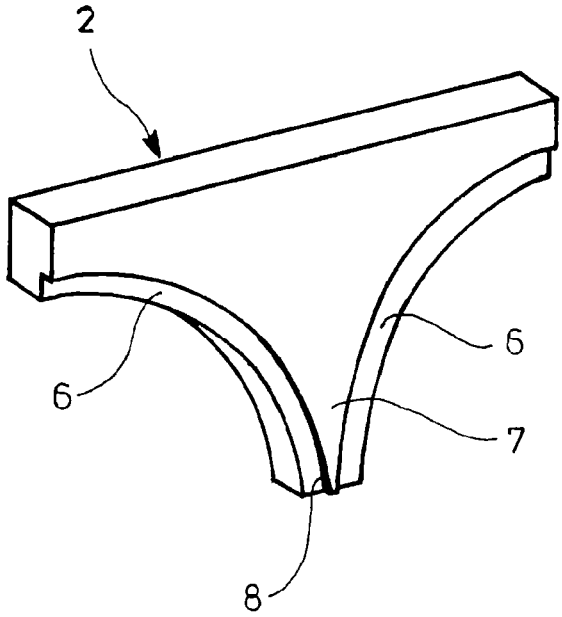
FIG. 2 is a perspective view showing a side weir with arcuate worn steps developing.
Figure 3:
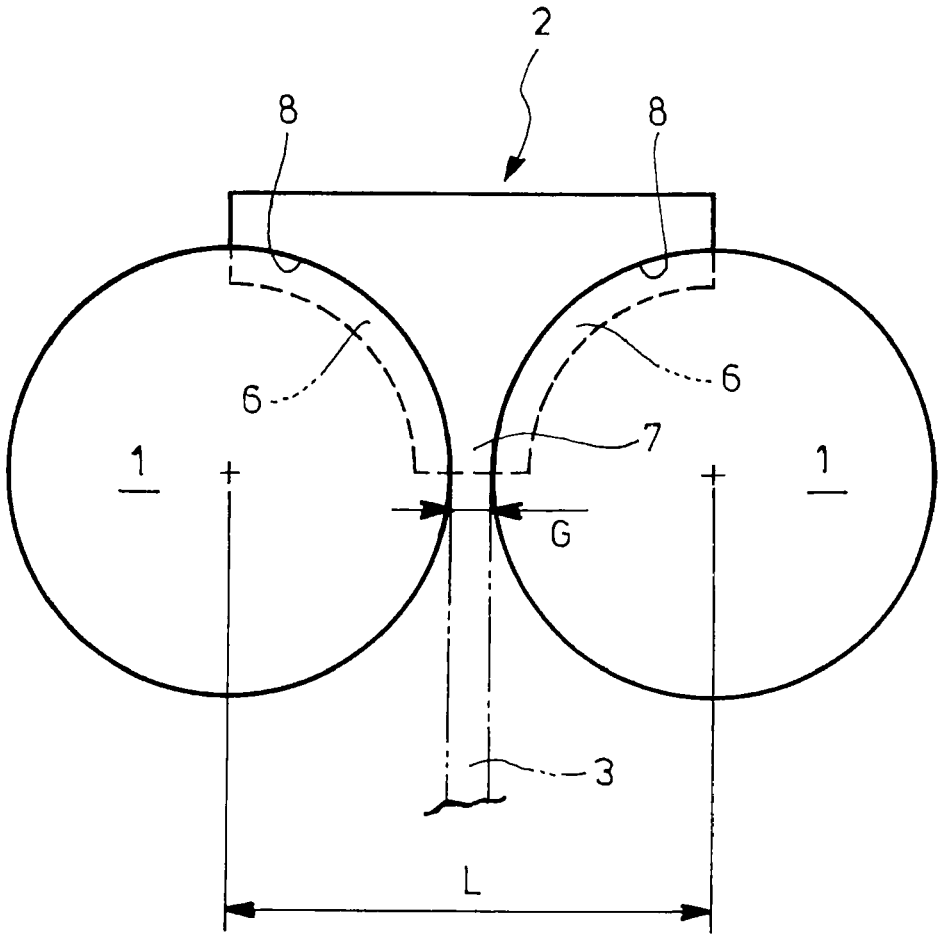
FIG. 3 is a schematic view showing relationships between the side weirs and the chilled rolls shown in FIG. 2.
Figure 4:
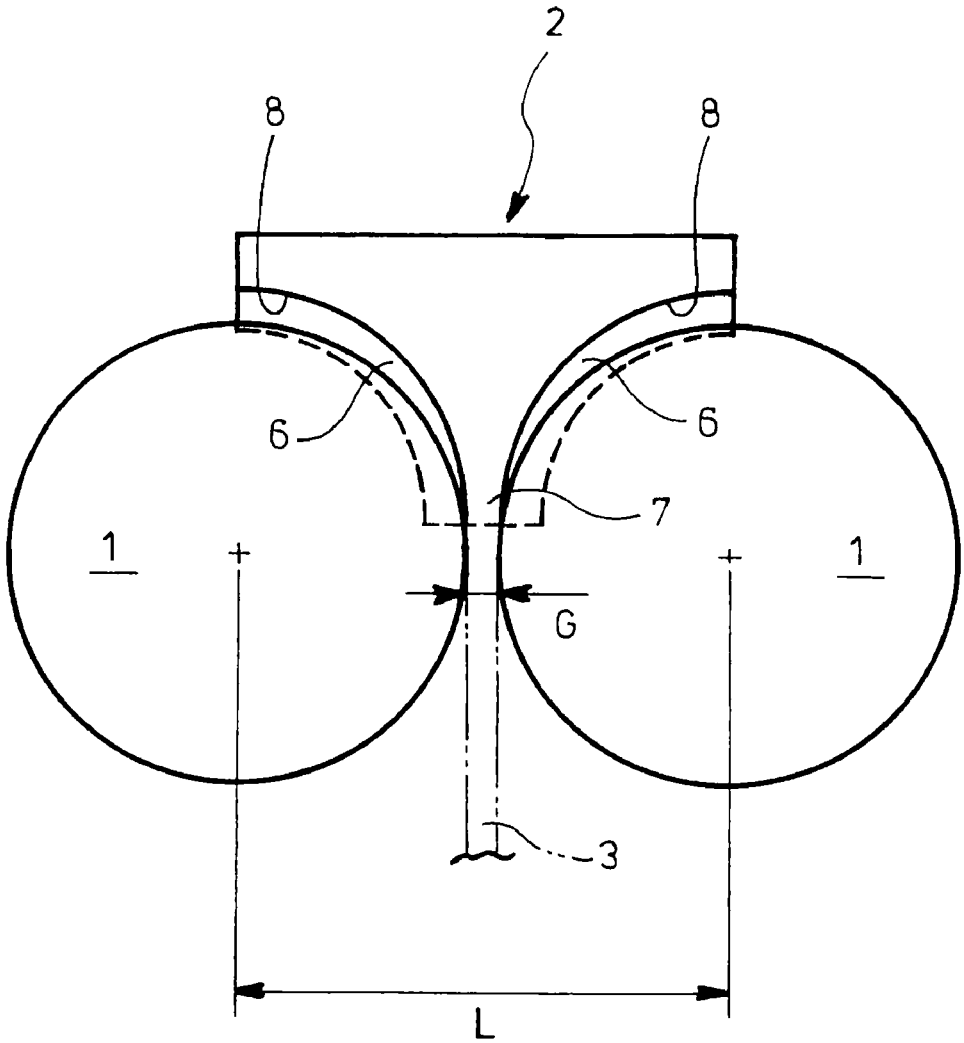
FIG. 4 is a schematic view showing an embodiment of an operating method for the twin-roll casting machine according to the invention.
Figure 5:
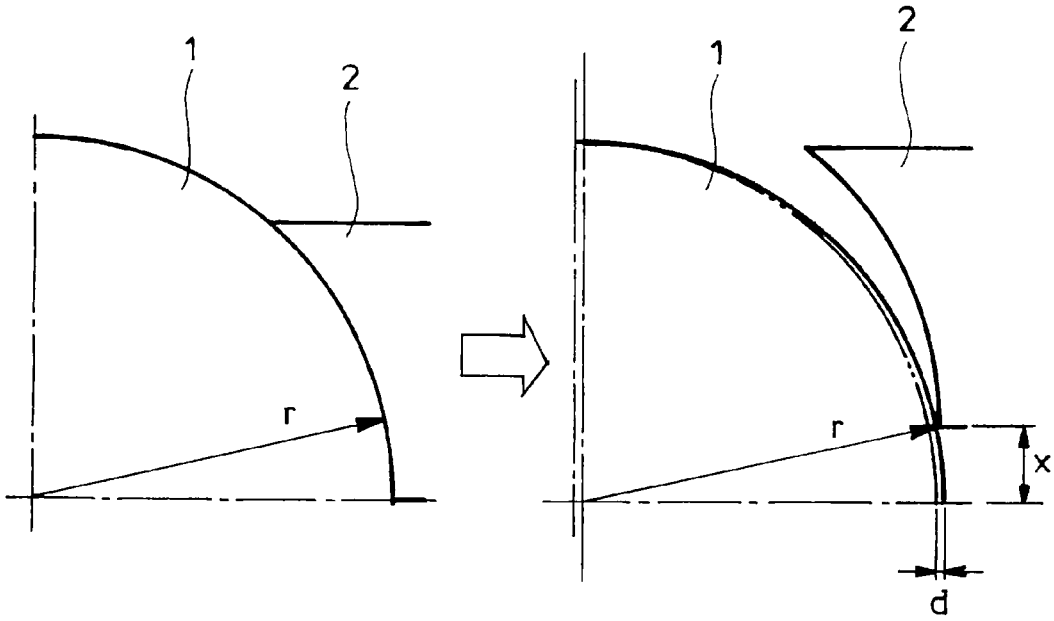
FIG. 5 is a schematic view showing relative positions between the casting roll and the side weir in connection with FIG. 4.
Figure 6:
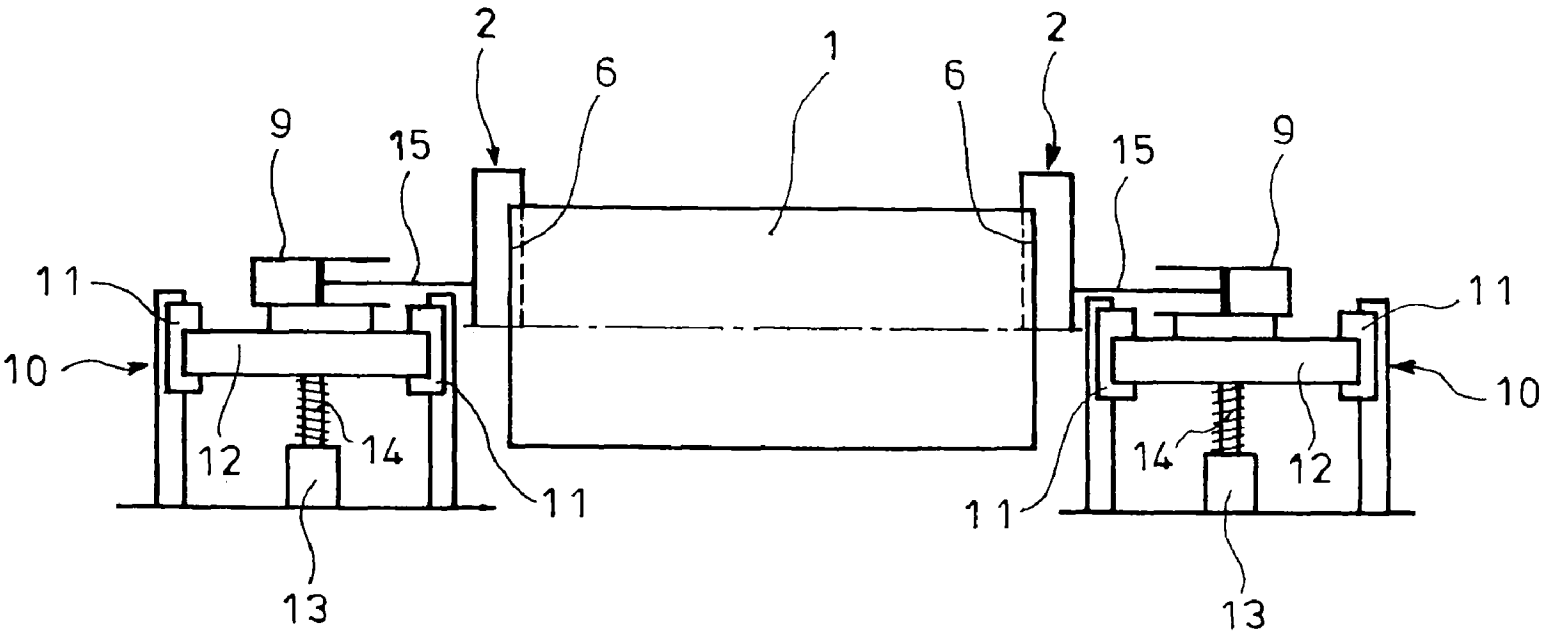
FIG. 6 is a schematic view showing an embodiment of a side weir supporting device according to the invention.

FIGS. 4 and 5 show an embodiment of an operating method for a twin-roll casting machine and FIG. 6 shows an embodiment of a side weir supporting device. In the figures, parts similar to those in FIGS. 1-3 are represented by the same reference numerals.

The side weir supporting device comprises pressing cylinders for pressing side weirs 2 against ends of a pair of chilled rolls 1 horizontally juxtaposed, and position adjusting mechanisms 10 for vertically displacing the side weirs 2, the side weirs 2 having arcuate worn steps 6 formed due to rotational sliding contact of the rolls 1.

Each of the position adjusting mechanisms 10 comprises a platform 12 close to the corresponding side weir 2 and vertically guided by direct-acting bearings 11, and a ball screw 14 which transmits rotation of a servo motor 13, as vertical displacement, to the platform 12.

The pressing cylinder 9 is mounted on the platform 12 of the adjusting mechanism 10 such that a piston rod 15 of the cylinder is positioned in parallel with a rotational axis of the chilled roll 1. A tip of the piston rod 15 is connected to the side weir 2, so that the side weir 2 is pushed/pulled by the pressing cylinder 9.

During an operation of the twin-roll casting machine, where a steel strip 3 delivered downward from the nip G is to be reduced in thickness, the servo motors 13 are actuated to vertically displace the platforms 12, pressing cylinders 9 and side weirs 2 upward.

Then, the side weirs 2 are pressed by the pressing cylinders 9 into contact with the ends of the rolls 1 to prevent leakage of the molten steel.

Rise x of each of the side weirs 2 can be geometrically determined on the basis of increase/decrease in length of the center-to-center distance L between the rolls 1. For example, rise of the side weirs 2 is several millimeters or so, assuming that the twin-roll casting machine has the chilled rolls 1 with radius of about 250 mm, horizontal displacement of each roll being d, increase/decrease of the center-to-center distance L between the rolls 1 due to nip variation 2*d* being in a range of 0.2 to 0.3 mm (see FIG. 5).

TABLE 1

| | | | | | |
|---|---|---|---|---|---|
| roll radius | R | mm | 250 | 250 | 250 |
| horizontal displacement of each roll | D | mm | 0.1 | 0.15 | 0.2 |
| nip variation | 2d | mm | 0.2 | 0.3 | 0.4 |
| rise of side weirs | X | mm | 7.07 | 8.66 | 10.00 |

$$r^2=(r-d)^2+x^2$$

$$x=(d(2r-d))^{0.5} \qquad \text{[Equation 1]}$$

Then, forces are applied to bearing boxes (not shown) for rotary support of necks of the respective rolls 1 in directions toward each other to reduce the center-to-center distance L between the rolls 1, thereby setting thickness of the steel strip 3 to a target value.

Prior to reduction of the center-to-center distance L between the rolls 1, the side weirs 2 are displaced upward, so that prevented is interference between the boundary surfaces 8 adjacent to the arcuate worn steps 6 on the side weirs 2 and the outer peripheries of the chilled rolls 1, which makes it possible to acquire the steel strip 3 with less thickness.

The side weirs 2 can continue to be used, provided that the portions of the side weirs with the arcuate worn steps 6 formed have remaining thickness providing strength required for an operation of the twin-roll casting machine. As a consequence, the service life of the side weirs 2 is prolonged, leading to reduction in maintenance cost.

To the contrary, when the steel strip 3 delivered downward from the nip G is to be increased in thickness, the center-to-center distance L between the rolls 1 is increased by some appropriate means.

Then, the servo motors 13 are actuated to vertically displace the platforms 12, pressing cylinders 9 and side weirs 2 downward while the side weirs 2 are pressed by the pressing cylinders 9 to contact the ends of the rolls 1, which keeps overlapped degree of the side weirs to the ends of the rolls 1 and prevents leakage of the molten steel.

Just as mentioned previously, lowering of the side weirs 2 is several millimeters or so, assuming that the twin-roll casting machine has the chilled rolls 1 with radius of about 250 mm, horizontal displacement of each roll being d, increase/decrease of the center-to-center distance L between the rolls 1 due to nip variation 2*d* being in a range of 0.2 to 0.3 mm.

It is to be understood that an operating method for a twin-roll casting machine and a side weir supporting device of the invention are not limited to the above embodiments and that various changes and modifications may be made without departing from the scope of the invention.

INDUSTRIAL APPLICABILITY

A method for operating a twin-roll casting machine and a side weir supporting device according to the invention are applicable to production of strips made of various kinds of metals.

The invention claimed is:

1. An operating method for a twin-roll casting machine with arcuate worn steps developing on side weirs due to rotational sliding contact of chilled rolls, comprising:

reducing a center-to-center distance between the chilled rolls with the side weirs in contact with ends of the rolls being displaced upward where a strip from a nip between the rolls is to be reduced in thickness; and increasing the center-to-center distance between the rolls with the side weirs in contact with the ends of the rolls being displaced downward where the strip from the nip between the rolls is to be increased in thickness.

* * * * *